United States Patent [19]

Voss

[11] Patent Number: 4,745,847

[45] Date of Patent: May 24, 1988

[54] HELICAL SPLINED ROTARY ACTUATOR

[75] Inventor: Julian D. Voss, Bristol, Ind.

[73] Assignee: Pneumo Abex Corporation, Boston, Mass.

[21] Appl. No.: 92,616

[22] Filed: Sep. 3, 1987

[51] Int. Cl.[4] ..... F01B 3/00

[52] U.S. Cl. ..... 92/33; 92/31; 92/2; 92/51; 92/53; 92/116; 277/58

[58] Field of Search ..... 92/31, 33, 68, 69 R, 92/116, 51, 53, 2; 91/61; 74/99 A; 277/58

[56] References Cited

U.S. PATENT DOCUMENTS

| | | | |
|---|---|---|---|
| 2,154,555 | 4/1939 | Baer et al. | 92/2 |
| 3,141,387 | 7/1964 | Geyer | 92/33 |
| 3,255,806 | 6/1966 | Meyer | 92/33 |
| 3,393,610 | 7/1968 | Aarvold | 92/33 |
| 3,808,953 | 5/1974 | Herbst | 92/2 |
| 3,815,479 | 6/1974 | Thompson | 92/2 |
| 3,989,223 | 11/1976 | Burkhardt et al. | 92/33 |
| 4,036,309 | 7/1977 | Petreev et al. | 92/33 |
| 4,313,367 | 2/1982 | Weyer | 92/33 |
| 4,373,426 | 2/1983 | Weyer | 92/33 |
| 4,603,616 | 8/1986 | Zajac | 92/33 |

FOREIGN PATENT DOCUMENTS

| | | | |
|---|---|---|---|
| 1444798 | 8/1975 | United Kingdom | 92/33 |
| 0127080 | 12/1984 | European Pat. Off. | 92/33 |

*Primary Examiner*—Robert E. Garrett

*Assistant Examiner*—Thomas E. Denion

[57] ABSTRACT

Helical splined rotary actuator includes a pair of cylinder housings having inboard ends rotatably mounted in coaxial alignment on opposite ends of a center sleeve member. Contained within the housings are pistons having relatively large diameter helical spline connections with the inner diameters of the housings and smaller diameter straight spline connections with opposite ends of the sleeve member, whereby simultaneous axial movement of the pistons toward and away from each other causes relative rotation between the sleeve member and cylinder housings. The sleeve member may be connected to a first support intermediate the ends of the actuator. In like manner, the cylinder housings may be connected to a second support rotatable relative to the first support adjacent opposite ends of the sleeve member. End closures at the outboard ends of the housings have barrier sleeves extending coaxially into the outboard ends of the housings between the housings and pistons to act as barriers between the internal housing seals and external piston seals. The end closures are fixed relative to a shaft pinned to the sleeve member intermediate the ends thereof, whereby the housings are rotatable relative to the barrier sleeves but not axially movable relative thereto and the pistons are axially movable relative to the barrier sleeves but not rotatable relative thereto.

25 Claims, 2 Drawing Sheets

HELICAL SPLINED ROTARY ACTUATOR

BACKGROUND OF THE INVENTION

This invention relates generally, as indicated, to a helical splined rotary actuator, especially intended for use in controlling the movements of aircraft flight control surfaces and the like.

The actuator of the present invention is of a substantially balanced design including a dobule acting piston arrangement which operates in line to create substantially equal and opposite axial forces. Also, the actuator is desirably center mounted and has a center drive output to minimize distortion of the respective structures to which the center mount and center drive output are respectively connected resulting from the reaction torques produced in the actuator itself and to minimize the effect of large deflections of the structures on the actuator.

In such an actuator desing, it would be desirable to maximize the output torque for a given actuator envelope. Also, it would be desirable to make such an actuator lighter without sacrificing strength. Furthermore, it would be desirable to prolong the life of the actuator piston seals and reduce the chances of seal leakage.

SUMMARY OF THE INVENTION

In accordance with one aspect of the invention, relatively large diameter helical spline drive connections are provided between the actuator cylinder housings and actuator piston sleeves to maximize the output torque of the actuator for a given sized envelope.

In accordance with another aspect of the invention, the helical splined drive connections are preferably located relatively close to the actuator mounting lugs to improve actuator stiffness while reducing torsional wind-up in the cylinder housings, thus permitting the actuator to be made lighter without sacrificing strength.

Further in accordance with the invention, the actuator piston seals are desirably located outboard of the helical spline drive connections in a substantially no-load area adjacent the outboard ends of the actuator remote from the center mount and center drive for the actuator where the seals are not subjected to torsional, bending and structural loads, thus prolonging seal life and reducing the chances of seal leakage.

Also in accordance with the invention, the piston assemblies are desirably keyed to a center shaft to permit linear movement of the piston assemblies relative to the shaft but not relative rotational movement therebetween.

Further in accordance with the invention, sleeve members fixed relative to the shaft, extend coaxially between the respective piston heads and cylinder housings, thus acting as a barrier betweeen the seals at the outboard ends of the cylinder housings and the piston head seals, whereby such seals are subjected only to rotary or translating (linear) motion to further prolong the seal life and reduce the chances of seal leakage.

To the accomplishment of the foregoing and related ends, the invention, then comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
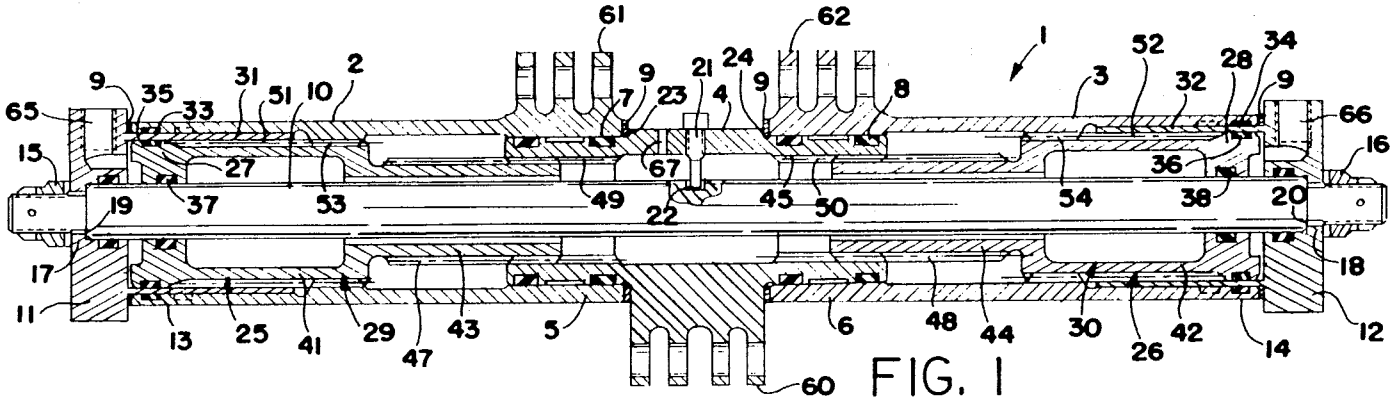
FIG. 1 is a schematic longitudinal section view through one form of helical splined rotary actuator in accordance with this invention in which the actuator piston assemblies are shown in their respective axial outermost positions.
Figure 2:
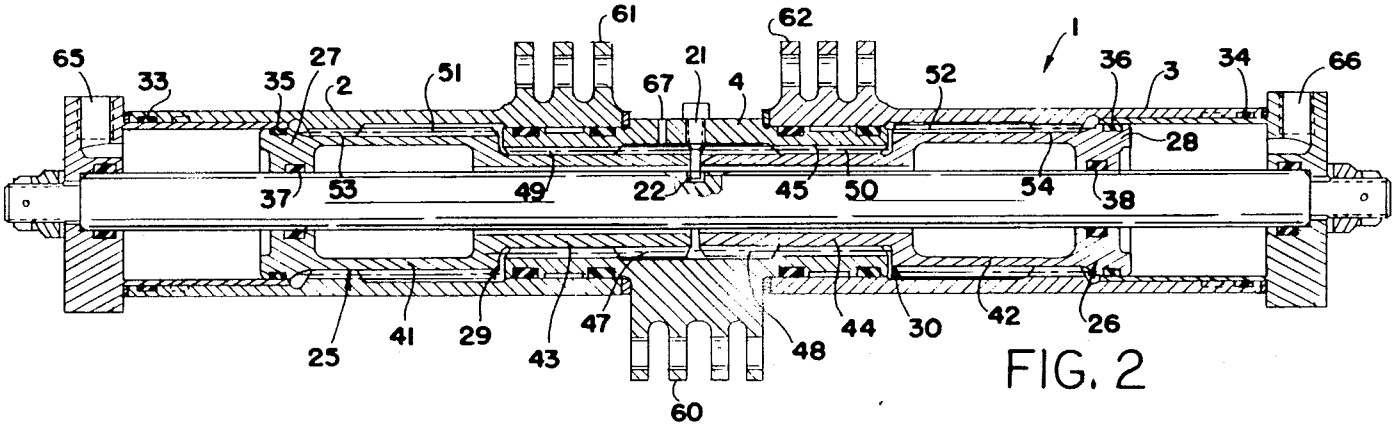
FIG. 2 is a schematic longitudinal section view through the actuator similar to FIG. 1, but showing the actuator piston assemblies in their axial innermost positions.

Referring now in detail to the drawings, and initially to FIGS. 1 and 2, there is shown one form of helical splined rotary actuator 1 in accordance with this invention which is of a symmetrical design including a pair of outer cylinder housings 2, 3 connected together in aligned spaced apart relation by means of a center member 4. The inboard ends 5, 6 of the respective cylinder housings 2, 3 are rotatably supported on opposite ends of the center member 4 to permit relative rotation between the center member and the cylinder housings, Suitable seals 7, 8 may be provided between the overlapping surfaces of the center member 4 and cylinder housings 2, 3 to prevent fluid leakage through such rotatable connections. Also, suitable thrust washers or bearings 9 may be located between the inboard ends 5, 6 of the respective housings 2, 3 and respective shoulders 23, 24 on the center member 4.

Extending coaxially within the center member 4 and cylinder housings 2, 3 is a center shaft 10. Shaft 10 may be supported at its opposite ends as by means of end closure members 11, 12 which may be used to close off the outboard ends 13, 14 of the cylinder housings 2, 3 as described hereafter. The end closure members 11, 12 may be securely fastened to the ends of the shaft 10 by lock nuts 15, 16 which when threaded onto such shaft ends, clamp internal flanges 17, 18 on the respective end closure members against external shoulders 19, 20 adjacent the respective ends of the shaft. The shaft 10 may in turn be held against rotation relative to the center member 4 as by means of one or more pins 21 extending radially through the center member 4 into one or more center recesses or holes 22 in the shaft. Also, suitable thrust washers or bearings 9 may be inserted between the outboard ends of the respective housings 2, 3 and adjacent end faces of the end closure members 11, 12.

Axially movable with each of the cylinder housings 2, 3 are respective piston assemblies 25, 26 each including piston heads 27, 28 having piston sleeves 29, 30 extending coaxially inwardly therefrom. Integral with the end closure members 11, 12 are respective cylindrical sleeves 31, 32 which extend coaxially inwardly between the respective cylinder housings 2, 3 and piston heads 27, 28 to form fluid seals with internal seals 33, 34 on the outboard ends 13, 14 of the housings and external seals 35, 36 on the piston heads 27, 28 thus providing a barrier between such seals for a purpose to be subsequently described. Also, the piston heads 27, 28 may be provided with internal piston seals 37, 38 in sliding sealed engagment with the outer diameter of the shaft 10 to prevent fluid leakage therebetween.

Each of the piston sleeves 29, 30 includes respective first sleeve portions 41, 42 having an outer diameter somewhat less than the inner diameter of the respective barrier sleeves 31, 32 and respective second sleeve portins 43, 44 of reduced diameter for reciprocal movement within the respective ends of a longitudinal bore 45 through the center member 4. The second sleeve portions 43, 44 have one or more external splinds 47, 48 thereon in meshing engagement with corresponding internal splines 49, 50 on the ends of the bore 45 in the center member 4. Similarly, one or more external splines 51, 52 are provided on the outer diameter of the first sleeve portions 41, 42 in meshing engagment with coresponding internal splines 53, 54 on the inner diameter of the cylinder housings 2, 3 inboard of the respective barrier sleeves 31, 32 and the pistons seals 35–38. By making one or both sets of splines 47–50 and 51–54 helical, when the outboard ends of the cylinder housings 2, 3 are simultaneously pressurized and the inboard ends are vented or vice versa, the resulting simultaneous movement of the piston assemblies 25, 26 toward or away from each other between the two extreme end positions shown in FIGS. 1 and 2 will be translated into rotary movement of the cylinder housings 2, 3 relative to the center member 4.

In the actuator embodiment shown in FIGS. 1 and 2, the larger diameter splines 51–54 are helical splines and the smaller diameter splines 47–50 are straight splines. Making the larger diameter splines 51–54 the helical splines and the smaller diameter splines 47–50 the straight splines has the advantage of producing the greatest output torque for a given size envelope. Also, the larger diameter internal helical splines 53, 54 are easier to manufacture than if the smaller diameter internal splines 49, 50 were made helical.

Also in the FIGS. 1 and 2 actuator embodiment, suitable mounting lugs 60 may extend radially outwardly from the center member 4 to facilitate attachment of the actuator 1 to a suitable support structure such as the relatively fixed structure of an aircraft (not shown) substantially centrally of the length of the actuator. In like manner, the inboard ends 5, 6 of both cylinder housings 2, 3 may be provided with mounting lugs 61, 62 immediately adjacent opposite ends of the center member mounting lugs 60 but in circumferentially spaced relation thereform to facilitate attachment of the cylinder housings to an aircraft flight control surface or other part to be rotated (not shown) substantially centrally of the length of the actuator.

With such a center mount 60 and center drive 61, 62, any distortion that is transmitted to the relatively fixed and movable surfaces of the aircraft structure by the reaction torque produced within the actuator 1 itself will be minimal. Similarly, the aircraft structural deflections themselves will have minimal effect on the actuator 1 because of the centralized mounting of the actuator to the respective relatively fixed and movable surfaces of the aircraft. Also, the balanced loading on the actuator resulting from the balanced actuator design including the double acting piston arrangement 25, 26 which operates in line, creates equal and opposite axial forces that cancel each other. Furthermore, because the large diameter helical splines 51–54 are located inboard of the piston seals 35–58, such helical splines are free to be positioned relatively close to the mounting lugs 60–62. This has the advantage of improving actuator stiffness while reducing torsional wind-up in the cylinder housings 2, 3, thus permitting a lighter actuator to be used without sacrificing strength.

Another advantage of such actuator design is that the piston seals 35–38 may be located outboard of the helical splines 51–54 remote from the center mount 60 and center drive 61, 62 of the actuator in a substantially no-load area where they will not be subjected to torsional, bending, and aircraft loads, whereby the seal life is prolonged and there is less chance of seal leakage. Moreover, the inclusion of the barrier sleeves 31, 32 between the outboard ends 13, 14 of the cylinder housings 2, 3 and piston heads 27, 28 has the advantage that the cylinder housing seals 33, 34 and piston head seals 35, 36 are subjected only to rotary or translating motion and not both, thus further prolonging seal life and reducing the chances of seal leakage.

In the actuator embodiment shown in FIGS. 1 and 2, the center member 4 is intended to be relatively fixed and the cylinder housings 2, 3 rotatable relative to the center member. Accordingly, the barrier sleeves 31, 32 are also relatively fixed, being integral with the end closure members 11, 12 which are fixed to the shaft 10 by means of the lock nuts 15, 16, and the shaft 10 in turn being fixed to the center member 4 by means of one or more pins 21. The net result is that the shaft seals 35–38 are only subjected to translating motion during axial movement of the piston assemblies 25, 26, whereas the cylinder housing seals 33, 34 and seals 7, 8 are only subjected to rotary motion and not both.

Figure 3:
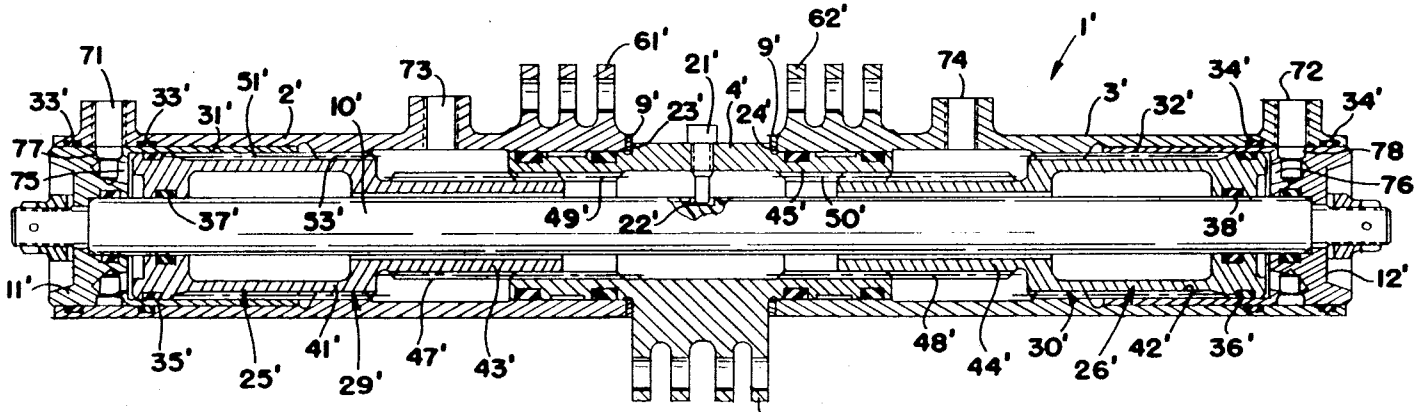
FIG. 3 is a schematic longitudinal section view through another form of helical splined rotary actuator in accordance with this invention.

Alternatively, if the center member 4' was connected to the rotatable member and the cylinder housings 2', 3' were connected to relatively fixed structure as is intended in the FIG. 3 embodiment, axial movement of the piston assemblies 25', 26' toward or away from each other would also cause the piston assemblies to rotate relative to the cylinder housings. Such rotational movement of the cylinder housings would in turn cause the center member 4' and associated shaft 10' and end closures 11', 12' and barriers sleeves 31', 32' to rotate a corresponding amount. Accordingly, the piston seals 35'–38' would still only be subjected to translating motion, and the cylinder housing seals 33', 34' only subjected to rotary motion and not both.

When the center member 4 is relatively fixed and the cylinder housings 2, 3 are relatively rotatable as is intended in the FIGS. 1 and 2 embodiment, the fluid ports 65–67 for respectively venting and pressurizing opposite sides of the piston assemblies 25, 26 are desirably provided in the center member 4 and end closure members 11, 12 as shown. On the other hand, when the cylinder housings 2', 3' are relatively fixed and the center member 4' is rotatable relative to the cylinder housings as is intended in the FIG. 3 embodiment, all of the fluid ports 71–74 are desirably provided in the cylinder housings 2', 3', with the outboard ports 71, 72 communicating with fluid passageways 75, 76 in the end closure members 11', 12' through respective external annular grooves 77, 78 in such end closure members as shown in FIG. 3. Otherwise, the details of construction and operation of the FIG. 3 actuator embodiment are substantially the same as the actuator 1 previously described, and the same reference numerals followed by a prime symbol are used to designate like parts.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. An actuator comprising a cylinder housing, a piston axially movable in said housing, means for causing relative rotation between said piston and housing during axial movement of said piston relative to said housing, a barrier sleeve extending coaxially into one end of said housing between said housing and said piston, said housing having internal seal means in sliding sealed engagement with the exterior of said barrier sleeve, and said piston having external seal means in sliding sealed engagement with the interior of said barrier sleeve, and means permitting relative axial movement between said piston and barrier sleeve but not relative rotational movement.

2. The actuator of claim 1 further comprising an end closure at said one end of said housing, said barrier sleeve being integral with said end closure.

3. The actuator of claim 2 wherein said means permitting relative axial movement between said piston and barrier sleeve but not relative rotational movement comprises a shaft extending coaxially within said housing and through an axial bore in said piston, said closure member being fixed to one end of said shaft, and means permitting axial movement of said piston along said shaft while preventing relative rotation therebetween.

4. The actuator of claim 3 further comprising internal seal means between said piston and said shaft.

5. The actuator of claim 3 wherein said means for permitting axial movement of said piston along said shaft but not relative rotation therebetween comprises a sleeve member fixed with respect to said shaft, said sleeve member having a straight spline connection with said piston permitting axial movement of said piston relative to said sleeve member but not relative rotational movement therebetween.

6. The actuator of claim 5 wherein said sleeve member extends part way into the other end of said housing to provide a rotatable connection between said sleeve member and housing, said sleeve member including first attachment means for attachment of said sleeve member to a first support, and said housing including second attachment means for attachment of said housing to a second support which is rotatable relative to said first support.

7. The actuator of claim 6 wherein said second attachment means is on the other end of said housing remote from said end closure and immediately adjacent said first attachment means.

8. The actuator of claim 7 wherein said means for causing relative rotation between said piston and housing comprises internal helical splines on the inner diameter of said housing engageable with external helical splines on said piston.

9. The actuator of claim 8 wherein said internal helical splines on said housing are located axially inwardly of said barrier sleeve between said seals and said second attachment means.

10. The actuator of claim 9 wherein said piston includes a first sleeve portion containing said external helical splines having an outer diameter slightly less than the inner diameter of said housing, and a second sleeve portion having an outer diameter less than said first sleeve portion, said second sleeve portion having external straight splines engageable with internal straight splines on said sleeve member to provide said straight spline connection.

11. The actuator of claim 6 further comprising fluid port means in said sleeve member and closure member for respectively venting and pressurizing opposite sides of said piston.

12. The actuator of claim 6 further comprising fluid port means in said housing for respectively venting and pressurizing opposite sides of said piston.

13. The actuator of claim 12 wherein said end closure member has an external annular groove in fluid communication with one of said fluid port means in said housing, and a fluid passage in said end closure providing fluid communication between said external annular groove and one side of said piston.

14. An actuator comprising a sleeve member, a pair of cylinder housings having inboard ends rotatably mounted on opposite ends of said sleeve member, pistons simultaneously axially movable toward and away from each other within said housings, drive means for causing relative rotation between said pistons and housings during such axial movement of said pistons, said drive means including means for permitting axial movement of said pistons relative to said sleeve member but not relative rotational movement, said sleeve member including first attachment means for attachment of said actuator to a first support intermediate the ends of said actuator, and each of said housings including second attachment means adjacent opposite ends of said first attachment means for attachment of said housings to a second support which is rotatable relative to said first support.

15. The actuator of claim 14 further comprising barrier sleeves extending coaxially into the outboard ends of said housings between said housings and said pistons, said housings having internal seals in sliding sealed engagement with the exterior of said barrier sleeves, and said pistons having external seals in sliding sealed engagement with the interior of said barrier sleeves.

16. The actuator of claim 15 further comprising means permitting relative axial movement between said pistons and barrier sleeves but not relative rotational movement.

17. The actuator of claim 16 wherein said means permitting relative axial movement between said pistons and barrier sleeves but not relative rotational movement comprises end closures at the outboard ends of said housings, said barrier sleeves being integral with said end closures, a shaft extending coaxially within said housings and through axial bores in said pistons, said end closures being fixed to opposite ends of said shaft, said pistons being axially movable along said shafts, and means for preventing relative rotation between said pistons and said shaft during such relative axial movement.

18. The actuator of claim 17 further comprising internal seal means between said pistons and said shaft.

19. The actuator of claim 17 wherein said means for permitting relative rotation between said pistons and said shaft comprises means fixing said sleeve member to said shaft intermediate the ends of said shaft, said sleeve member having internal straight splines in opposite ends thereof engageable by external straight splines on the inboard ends of said pistons permitting axial movement of said pistons relative to said sleeve member but not relative rotational movement.

20. The actuator of claim 19 wherein said drive means comprises internal helical splines on the inner diameter of said housings engageable with external helical splines on said pistons.

21. The actuaator of claim 20 wherein said pistons include first sleeve portions having outer diameters slightly less than the inner diameters of said housings, said first sleeve portions having said external helical splines thereon, and second sleeve portions having outer diameters less than the outer diameters of said first sleeve portions, said second sleeve portions having said external straight splines thereon engageable with said internal straight splines on said sleeve member.

22. The actuator of claim 21 wherein said internal helical splines on said housings are located axially inwardly of said barrier sleeves between said seals and said second attachment means.

23. The actuator of claim 22 further comprising fluid port means in said sleeve member and end closures for respectively venting and pressurizing opposite sides of said pistons to cause said pistons to move toward and away from each other.

24. The actuator of claim 22 further comprising fluid port means in said housings for respectively venting and pressurizing opposite sides of said pistons to cause said pistons to move toward and away from each other.

25. The actuator of claim 24 further comprising annular external grooves in said end closures in communication with one of said fluid port means in said housings, and passage means in said end closures communicating said annular grooves with one side of said pistons.

* * * * *